US005299942A

United States Patent [19]

Burke et al.

[11] Patent Number: 5,299,942

[45] Date of Patent: Apr. 5, 1994

[54] INPUT-OUTPUT ELECTRICAL CONNECTOR

[75] Inventors: Rodger W. Burke, Lisle; Philip J. Dambach, Naperville; Paul A. Reisdorf, LaGrange, all of Ill.

[73] Assignee: Molex Incorporated, Lisle, Ill.

[21] Appl. No.: 18,970

[22] Filed: Feb. 18, 1993

[51] Int. Cl.[5] ..... H01R 27/02

[52] U.S. Cl. ..... 439/79; 439/925

[58] Field of Search ..... 439/68-73, 439/76, 77, 79, 80, 485, 495, 925

[56] References Cited

U.S. PATENT DOCUMENTS

| | | | |
|---|---|---|---|
| 4,764,122 | 8/1988 | Sorel et al. | 439/66 |
| 4,993,956 | 2/1991 | Pickles et al. | 439/76 |
| 5,125,846 | 6/1992 | Sampson | 439/925 |
| 5,159,532 | 10/1992 | Kilian et al. | 361/388 |

*Primary Examiner*—Neil Abrams
*Attorney, Agent, or Firm*—A. A. Tirva

[57] ABSTRACT

An electrical connector system is provided for electrically coupling a plurality of conductors with a printed circuit board. The system includes a main housing for mounting on one side of the printed circuit board, the board having an IC chip on the opposite side thereof. Main terminals are mounted on the main housing for coupling the conductors to circuits of the printed circuit board. A unitary secondary housing is adapted for mounting on the opposite side of the printed circuit board and includes an integral shield portion for covering the IC chip and providing electrostatic discharge protection therefor. Apertures are provided in the shield portion to allow for cooling of the IC chip. The unitary secondary housing includes at least one integral header portion defining a receptacle for receiving a complementary electrical connector. Terminals are mounted in the secondary housing and have contact means located in the receptacle for interengagement with contacts of the complementary electrical connector and tails for interengagement with circuit traces on the printed circuit board.

5 Claims, 2 Drawing Sheets

INPUT-OUTPUT ELECTRICAL CONNECTOR

FIELD OF THE INVENTION

This invention generally relates to the art of electrical connectors and, particularly, to an input-output electrical connector for electrically coupling a plurality of conductors with an electronic component or device, and including header connector receptacles.

BACKGROUND OF THE INVENTION

There are many applications in the electronic industry, such as in copying machines, computers and the like, wherein a plurality of conductors must be terminated to various electronic components to carry out various functions of a machine or apparatus. For instance, in a copying machine, control electronics are fed through data conductors or lines and power conductors or lines to various devices, such as motors, audible or visual indicators, or the like which perform the various functions of the machine, such as changing the reduction of the copying process, varying the numbers of copies, rendering audible or visual signals, and the like. Electronic components or devices, such as printed circuit boards, integrated circuit chips, headers or connectors must be coupled through electrical connectors to the power and data transmission conductors or lines.

An electronic system of the character described above is shown in U.S. Pat. No. 5,125,846 to Sampson et al., dated Jun. 30, 1992 and assigned the assignee of this invention. In that patent, a plurality of conductors are coupled to a printed circuit board. The board, itself, has an integrated circuit chip (IC chip) and a plurality of separate header connectors mounted thereon. The header connectors have terminal pins interconnected to circuit traces on the printed circuit board. In essence, the header connectors are separate connector devices, and the IC chip is exposed on top of the printed circuit board between the header connectors.

This invention is directed to an improved electronic system of the character described above and as generally shown in the U.S. Pat. No. 5,125,846, but which includes a multi-purpose upper or secondary housing which forms a plurality of header connectors on the printed circuit board, along with means for shielding the IC chip on the board from electrostatic discharge while affording cooling of the IC chip and, in one embodiment, affording deformation of the terminals of the header connectors from outside the housing.

SUMMARY OF THE INVENTION

An object, therefore, of the invention is to provide a new and improved input-output electrical connector system of the character described.

In the exemplary embodiment of the invention, an electrical connector system is provided for electrically coupling a plurality of conductors with a printed circuit board. A main housing has a first interface means for mounting one side of the printed circuit board on the housing and a second interface means for receiving the conductors. The printed circuit board has an IC chip on the outside thereof. Terminal means are mounted on the housing for coupling the conductors to circuits of the printed circuit board.

The invention contemplates the provision of a unitary secondary housing adapted for mounting on the opposite side of the printed circuit board. The unitary secondary housing includes at least one integral header portion defining a receptacle for receiving a complementary electrical connector. Terminal means are mounted in the header portion and have contact means located in the receptacle for engagement with contact means of the complementary electrical connector and tail means for interengagement with circuit traces on the printed circuit board. The unitary secondary housing also includes an integral shield portion for covering the IC chip and providing electrostatic discharge protection therefor.

In the preferred embodiment of the invention, the unitary secondary housing includes a pair of the integral header portions and respective terminal means, with the integral shield portion being located therebetween. Aperture means are provided in the shield portion for providing cooling means for the IC chip. The aperture means are located in the shield portion at a location to afford access therethrough to the terminal means of the header portions, thereby allowing deformation of the terminals from outside the secondary housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
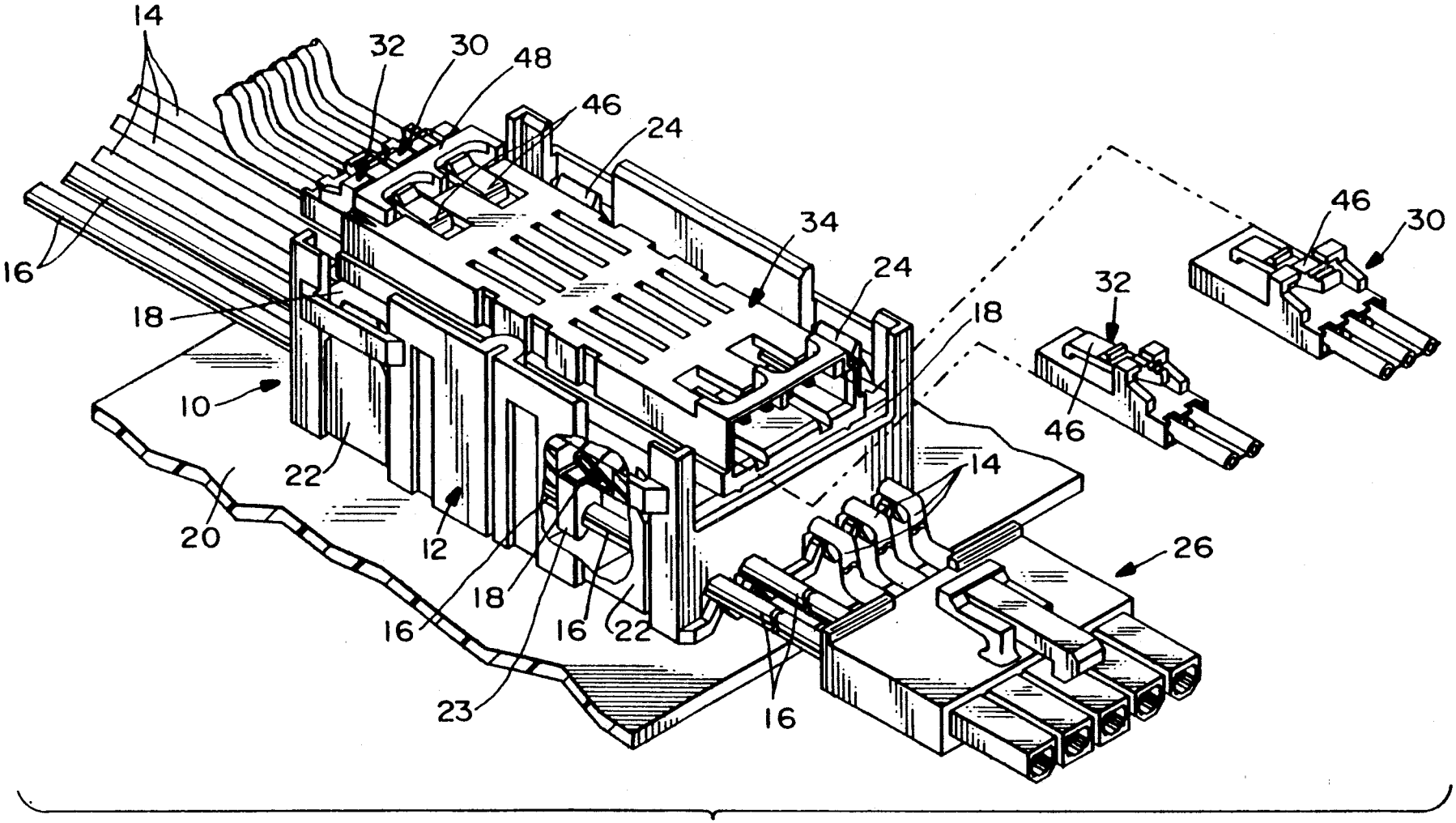
FIG. 1 is a perspective view of an electrical connector assembly or system embodying the concepts of the invention.

Referring to the drawings in greater detail, and first to FIG. 1, an electrical connector assembly, generally designated 10, is shown to include a common or main housing, generally designated 12. The electrical connector assembly is an input-output connector for coupling a plurality of conductors with an electronic component. As illustrated in FIG. 1, the conductors are conventional discrete insulated conductor wires, including three data transmission wires 14, and two power transmission wires 16. The electronic component is shown in the form of a conventional printed circuit board 18 having circuit traces thereon. As shown in the aforesaid U.S. Pat. No 5,125,846, an integrated circuit chip 52 is mounted on top of printed circuit board 18, generally at a central location thereof.

Connector assembly 10 may be mounted on a supporting substrate 20. Housing 12 includes a plurality of resilient latch arms 22 having inwardly directed latch hooks 24 for snapping over the top of printed circuit board 18 to hold the printed circuit board in an assembled position spaced above substrate 20 and data and power transmission lines 14 and 16, respectively. As shown in the aforesaid U.S. Pat. No. 5,125,846, conventional insulation displacement/surface mount type terminals (only one is shown in FIG. 1) are mounted within housing 12 and interconnect the data and power conductor wires to circuit traces on circuit board 18. A connector, generally designated 26, may be terminated to data and power transmission wires 14 and 16, respectively, whereby the data and power lines can be readily coupled to a complementary electrical connector (not shown).

Connector assembly can be used for distributing power and data through an electrical apparatus requiring such distribution. Control electronics from a control station run through a machine in data and power transmission lines 14 and 16, respectively. Connector assembly 10 includes terminals which terminate the lines to circuit traces on printed circuit board 18, and the centrally located IC chip distributes the power and data to various devices in the machine through a plurality of data connectors, generally designated 30, and power connectors, generally designated 32. The data and power connectors are electrically coupled to various devices such as motors, audible and visual indicating means, and the like, on the machine. For instance, the control electronics may include an actuator to change the degree of reduction of a copy machine from an original copy sheet. The IC chip on printed circuit board 18 will tell a motor on the machine its respective function, through one of connectors 30 and 32 leading to the particular motor.

Figure 2:
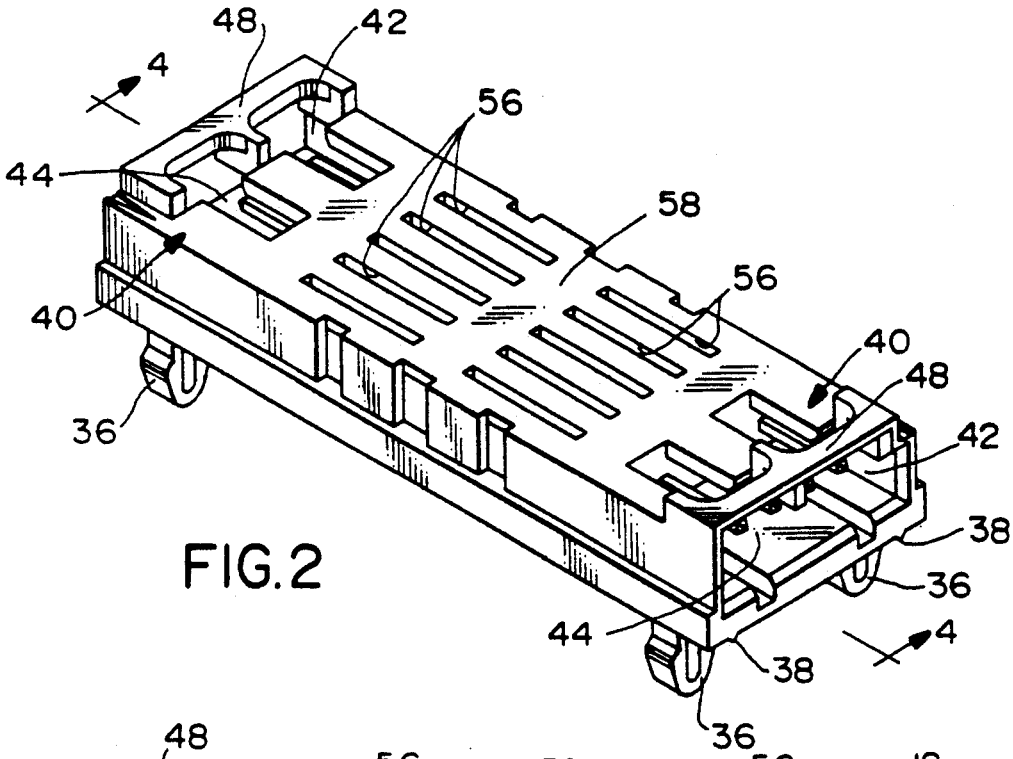
FIG. 2 is a perspective view of the unitary secondary housing of the invention.
Figure 3:
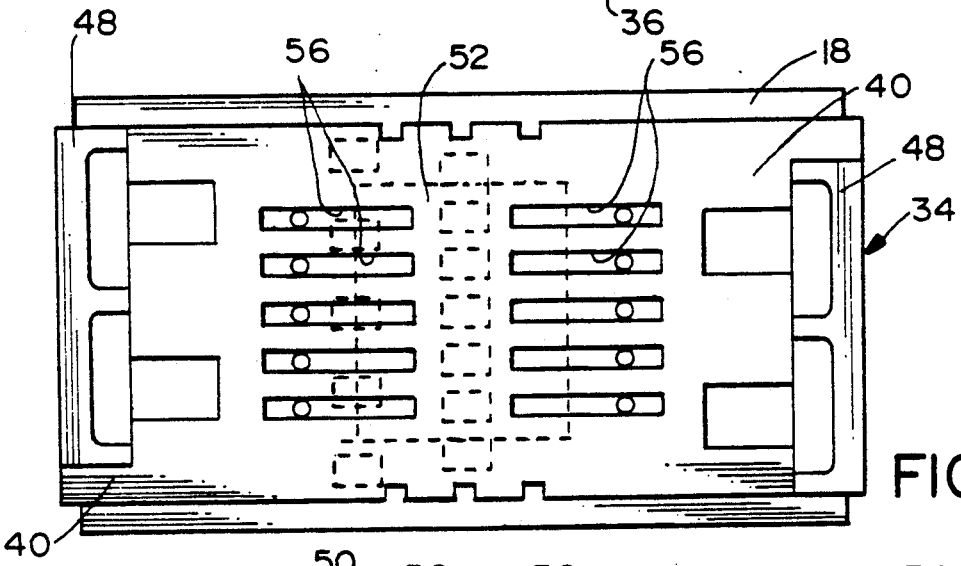
FIG. 3 is a top plan view of the housing of FIG. 2.
Figure 4:
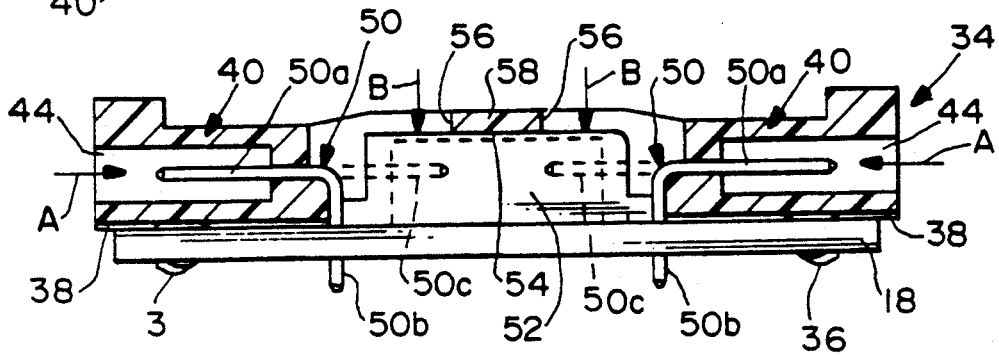
FIG. 4 is a vertical section taken generally along line 4—4 of FIG. 2.

Referring to FIGS. 2–4 in conjunction with FIG. 1, the invention contemplates the provision of a unitary secondary housing, generally designated 34, for mounting on top of printed circuit board 18, with the circuit board mounted in or on main housing 12 of connector assembly 10. In essence, secondary housing 34 is mounted to a side of the printed circuit board opposite the side thereof which has circuit traces terminated to data and power conductor wires 14 and 16, respectively. The secondary housing has a plurality of mounting pegs or boardlocks 36 which project into appropriate mounting holes in printed circuit board 18 for mounting the secondary housing on top of the board, as seen in FIG. 4. The underside of secondary housing 34 has a pair of elongated ribs 38 (FIG. 2) which provide standoff means for spacing the secondary housing from the upper surface of the circuit board.

Unitary secondary housing 34 is a multi-purpose component and performs a number of functions. First, the housing defines integral header portions, generally designated 40, at opposite ends thereof. Each header portion 40 defines a receptacle 42 for receiving a data line connector 30 (FIG. 1) and a receptacle 44 for receiving a power line connector 32. Connectors 30 and 32 are provided with resilient cantilevered latch arms 46 which snap behind an upper latch ledge 48 of each header portion 40, as seen by the two mated connectors 30 and 32 at the left-hand end of secondary housing 34 in FIG. 1.

As seen in FIG. 4, secondary housing 34 mounts a plurality of terminal means, generally designated 50. In the embodiment of FIGS. 2–4, the terminal means are provided by L-shaped pins including contact pin portions 50*a* projecting into receptacles 42,44 and tail portions 50*b* which project through appropriate holes in printed circuit board 18 for termination to circuit traces on the board or in the holes. When connectors 30 and 32 are mated with header portions 40 of unitary secondary housing 34, the terminals within connectors 30 and 32 mate with contact pin portions 50*a* of terminal means 50.

Unitary secondary housing 34 also provides a shielding means for the IC chip on printed circuit board 18. As stated above, the IC chip is located generally centrally of the circuit board, as indicated by dotted location 52 in FIG. 4. Consequently, secondary housing 34 has a cavity 54 on the underside thereof to accommodate the IC chip located between integral header portions 40.

Unitary secondary housing 34 further includes a plurality of apertures or slots 56 in a top wall 58 of the housing generally above the location of IC chip 52. The top wall shields or protects the IC chip. The slots allow convectional heat transfer to take place to cool IC chip 52, while the unitary secondary housing provides electrostatic discharge protection for the IC chip.

Lastly, slots 56 also are located in alignment with terminals 50 for allowing access therethrough to the terminals for deforming the terminals to their functional configurations. More particularly, the terminals of the embodiment shown in FIGS. 2–4, originally are provided in the form of straight "bandolier pins" inserted into receptacles 44 (FIG. 4) in the direction of arrows "A" to the position indicated by dotted lines 50*c*. An appropriate tool then can be inserted through slots 56 in the direction of arrows "B", into engagement with the straight terminal pins and, then, to bend the pins downwardly to the full-line "L-shaped" configurations shown in FIG. 4 prior to assembly of the housing 34 to the board 18. Therefore, even cooling slots 56 provide multiple functions within multi-purpose secondary housing 34.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector system for electrically coupling a plurality of conductors with a printed circuit board, including a main housing having first interface means for mounting one side of the printed circuit board on the housing and second interface means for receiving the conductors, the board having an IC chip on the outside thereof, and terminal means on the housing for coupling the conductors to circuits of the printed circuit board, wherein the improvement comprises a unitary secondary housing adapted for mounting on the opposite side of the printed circuit board and including an integral header portion defining a receptacle for receiving a complementary electrical connector, terminal means having contacts means located in the receptacle for interengagement with contact means of the complementary electrical connector and tail means for interengagement with circuit traces on the printed circuit board, an integral shield portion for covering the IC chip and providing electrostatic discharge protection thereof, and wherein said terminal means are deformable to operative configurations after the terminal means are mounted on the secondary housing, and including aperture means in the secondary housing for allowing access therethrough to the terminal means for deforming the terminal means.

2. In an electrical connector system as set forth in claim 1, wherein said unitary secondary housing includes a pair of said integral header portions and respective terminal means, with said integral shield portion being located therebetween.

3. In an electrical connector system as set forth in claim 1, wherein said secondary housing includes aperture means providing cooling means for the IC chip.

4. In an electrical connector system as set forth in claim 3, wherein said aperture means are located in the integral shield portion of the secondary housing.

5. In an electrical connector system as set forth in claim 3, wherein said terminal means are deformable to operative configurations after the terminal means are mounted on the secondary housing, and said aperture means are located for allowing access therethrough to the terminal means for deforming the terminal means.

* * * * *